United States Patent [19]

Kelly

[11] 4,255,777

[45] Mar. 10, 1981

[54] ELECTROSTATIC ATOMIZING DEVICE

[75] Inventor: Arnold J. Kelly, Princeton Junction, N.J.

[73] Assignee: Exxon Research & Engineering Co., Florham Park, N.J.

[21] Appl. No.: 853,499

[22] Filed: Nov. 21, 1977

[51] Int. Cl.[3] ..... B05B 5/00

[52] U.S. Cl. ..... 361/228; 239/704

[58] Field of Search ..... 361/227, 228, 229, 230; 239/706, 707, 690, 695, 704, 705

[56] References Cited

U.S. PATENT DOCUMENTS

| | | | |
|---|---|---|---|
| 2,600,129 | 6/1952 | Richards | 361/228 |
| 2,949,168 | 8/1960 | Peterson . | |
| 3,167,109 | 11/1965 | Wobig | 239/690 |
| 3,269,446 | 8/1966 | Luther | 239/704 X |
| 3,296,491 | 1/1967 | Brown | 239/690 X |
| 3,608,821 | 9/1971 | Simm et al. | 361/227 |
| 3,656,171 | 4/1972 | Robertson | 239/690 X |
| 3,660,656 | 5/1972 | Frank et al. | 361/229 |
| 3,680,779 | 8/1972 | Reilly | 361/227 |
| 3,806,763 | 4/1974 | Masuda | 361/227 |

OTHER PUBLICATIONS

"Combustion of Charged Droplets," Manuscript of Symposium, Institute for Mechanical Technology; Sep. 21, 1978.

*Primary Examiner*—J. D. Miller
*Assistant Examiner*—L. C. Schroeder
*Attorney, Agent, or Firm*—Richard E. Nanfeldt

[57] ABSTRACT

This invention relates to an electrostatic atomizing device and a process thereof for the formation of electrostatically charged droplets having an average diameter of less than about 1 millimeter for a liquid having a low conductivity wherein the device includes a cell having a chamber disposed therein, a discharge spray mechanism in communication with the cell, the liquid in the chamber being transported to the discharge spray mechanism and atomized into droplets, and a mechanism for passing a charge through the liquid within the chamber, wherein the charge is sufficient to generate free excess charge in the liquid within the chamber.

17 Claims, 7 Drawing Figures

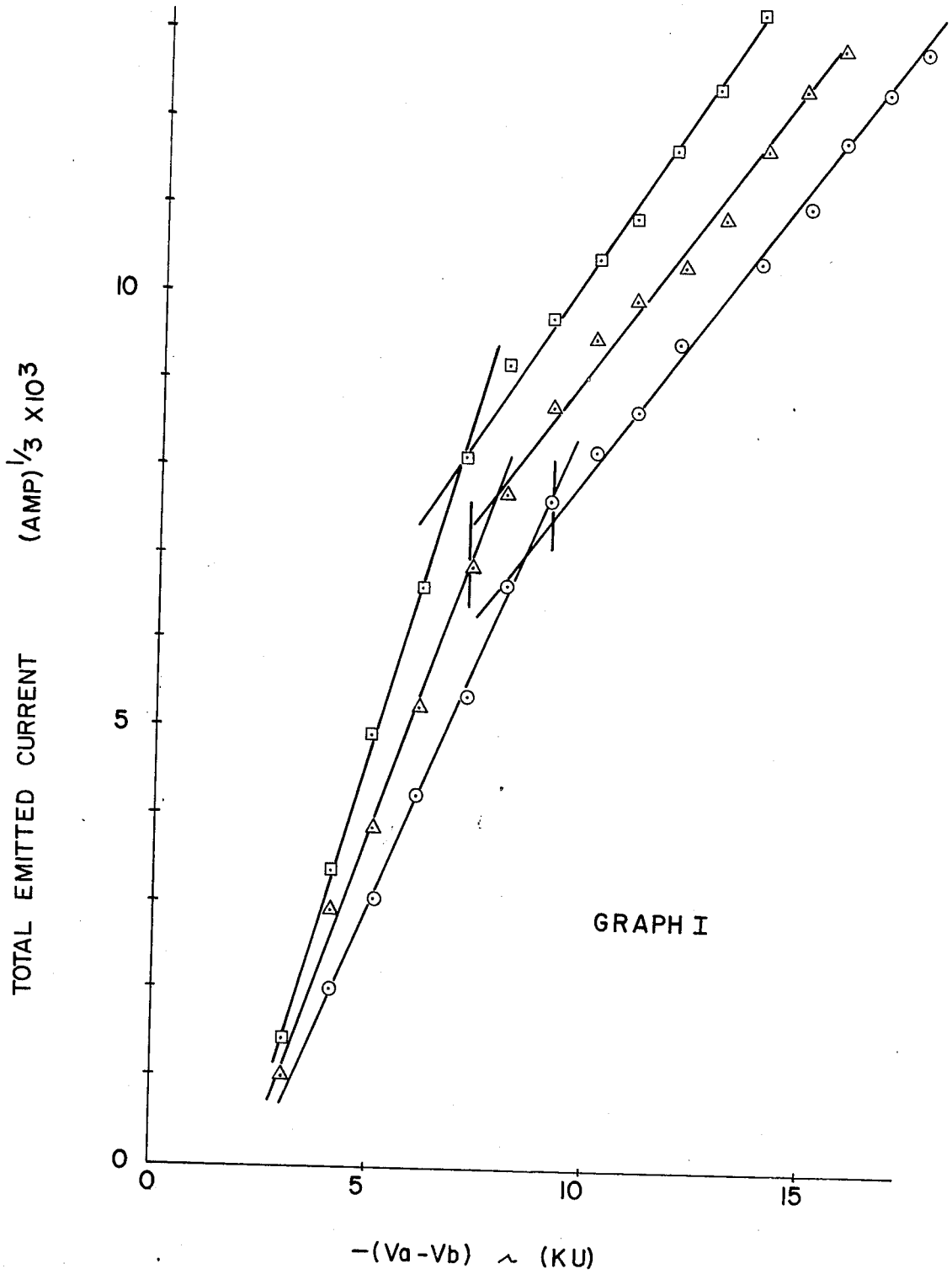
TOTAL EMITTED CURRENT (AMP)$^{1/3}$ X10$^3$
10
5
0
0
5
10
15
−(Va-Vb) ~ (KU)
GRAPH I

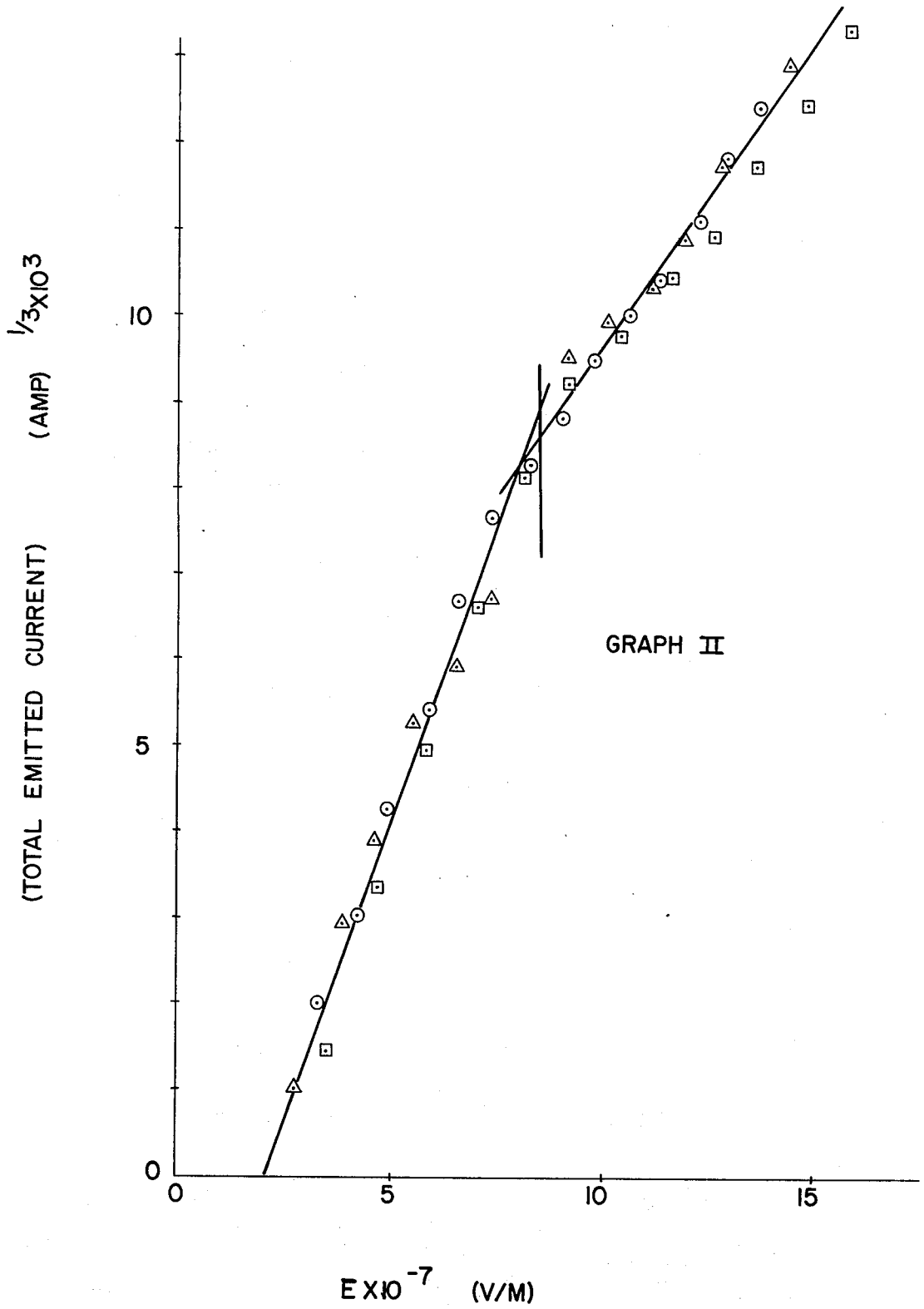
(TOTAL EMITTED CURRENT) 1/3 X10^3 (AMP)
10
5
0
0
5
10
15
GRAPH II
E X10^-7 (V/M)

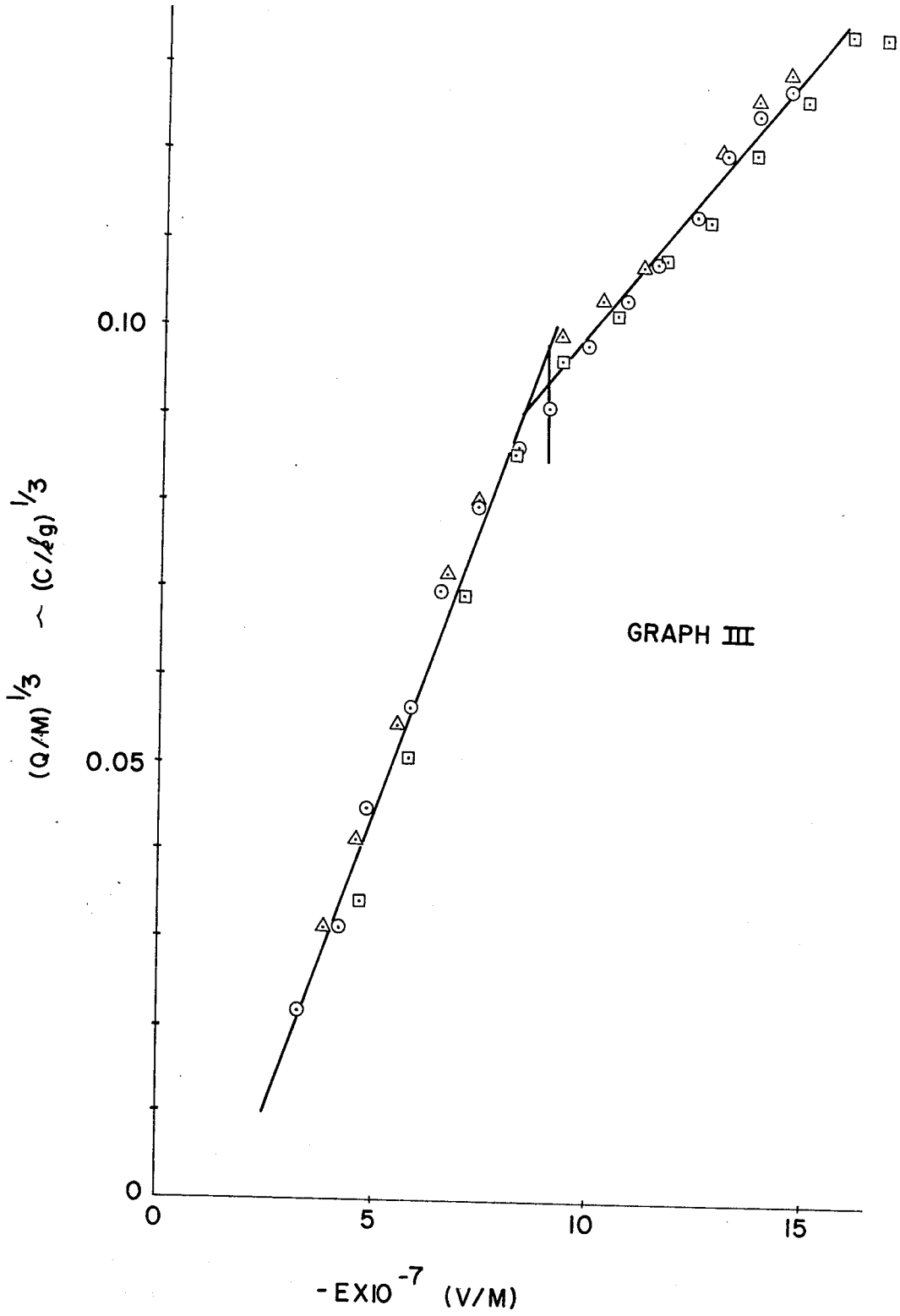
0.10
0.05
0
0
5
10
15
$(Q/M)^{1/3} \sim (C/\ell g)^{1/3}$
$-E \times 10^{-7}$ (V/M)
GRAPH III

ELECTROSTATIC ATOMIZING DEVICE

BACKGROUND OF THE INVENTION

1. Field of the Invention

This invention relates to an electrostatic atomizing device and a process thereof for the formation of electrostatically charged droplets having an average diameter of less than about 1 millimeter for a liquid having a low conductivity, wherein the device includes a cell having a chamber disposed therein, a discharge spray means in communication with the cell, the liquid in the chamber being transported to the discharge spray means and atomized into droplets, and a mechanism for passing a charge through the liquid within the chamber, wherein the charge is sufficient to generate free excess charge in the liquid within the chamber.

2. Description of the Prior Art

The literature is saturated with various types of electrostatic atomizing devices which are of limited adaptability due to a number of factors such as the inability to be functionally operable in air, the inability to atomize low conductivity liquids, and the inability to form droplets having an average diameter of less than about 10 microns with commercially acceptable flow rates.

U.S. Pat. No. 3,358,731 is a combustion burner device having a diode type electrostatic atomizing device, wherein the charged droplets are attracted to a downstream charged surface having a lower electrical potential than the atomizing device. This atomizing device produces droplets having large diameters.

U.S. Pat. No. 3,597,668 relates to an electrostatic fuel charging device for use with an internal combustion engine, wherein a friction element disposed within a cylindrically shaped casing imparts an electrostatic charge to a liquid fuel flowing through the casing.

U.S. Pat. No. 3,167,109 relates to a diode type electrostatic atomizing device employing a convective flow of charged air in order to electrostatically charge a liquid externally to a liquid supply cell.

The device of U.S. Pat. No. 2,525,347 is a spray diode. In all instances cited electrostatic atomization of fluid occurs from a small radius of curvature edge or edges over which the fluid passes. Atomization proceeds in response to an electric field established between this edge and the object or objects toward which the spray is to be directed. High potential voltage is stated as being necessary for operation in conjunction with the object, nozzle separation distances noted. Without exception operation is at ambient conditions with the interelectrode gap in air.

This invention differs from the process claimed here in that no claim is made with respect to forceable charge injection into the spray fluid. Since the spray fluid is charged by charge release from a sharpened surface in response to large electric fields developed by large potential differences operating over large air gaps, the flow rate is restrained to that capable of just forming a thin layer over the sharp edge. This is consistent with the absence of the third electrode whose presence within the liquid would assure sufficient charge injection to permit large volume flow rate spraying.

U.S. Pat. No. 3,775,193 teaches that a passivating liquid flows thru an aperture through which an electrode protrudes. A high intensity electric discharge is maintained between this electrode and the metallic surface being passivated by the fluid. This operation is typically conducted in a vacuum below $10^{-4}$ torr. The discharge between the electrode and surface produce atomization of sufficient intensity to reduce droplet size below 200 $\mu$m.

Small flows are indicated as being associated with this procedure. The presence of only two electrodes, the central spray head electrode and the work surface distinguish this invention from the spray head concept of the instant invention. The presence of a high intensity electric discharge between the head electrode and the work piece noted as being central to the methods' mode of operation and to the atomization process indicates the principle of operation is functionally distinct from the charge injection process of the spray diode.

U.S. Pat. No. 3,167,109 reveals a coaxial device in which electrostatic fields are used to: (1) provide an "electric wind" effect to move air to the combustion zone, and (2) produce atomization and spraying of liquid fuel into the air preparatory to combustion. Electrostatic atomization of fuel occurs from a centrally located supply electrode in response to a potential difference that exists between it and another electrode. Air moves within the annular space defined by the two electrodes.

Electrostatic atomization is limited in this device by the maximum electric field capable of being sustained across the air gap. This device is clearly a spray diode since it lacks an essential electrode immersed in the spray fluid. As a consequence its spray performance is limited to low flow rates.

U.S. Pat. No. 3,269,446 teaches that the liquid fuel is supplied to an annular manifold from which it flows vertically downward and radially outwardly over a conical surface, the lower edge of which is sharp. Electrostatic spraying occurs from this edge by action of an electrostatic field that exists between the spray cone and an annular coaxially positioned ring electrode having a larger diameter, and placed lower than the cone. An alternate embodiment of this device replaces the second ring electrode by a circular cylindrical screen electrode surrounding the centrally located spray cone. A second alternation replaces the cone with a horizontal sharp disc having a sharp edge from which spraying occurs to the ring electrode.

In all three instances an air gap exists between the two (and only) electrodes responsible for spraying. Consequently the devices are all subject to air breakdown effects which limit their capability to spray large volumes of low conductivity liquids—the devices are spray diodes—being only a pair of electrodes.

A paper by Tsui and Hendricks (RSI, Vol. 39, August 1969) reveals a coaxial device designed to disrupt an otherwise uniform column of liquid into a co-linear stream of uniform sized droplets ($\sim$300 $\mu$m diameter). This is accomplished by positioning a pointed rod coaxially with the exit hole through which the liquid flows. Imposition of an alternating voltage differential between the pointed electrode and the orifice plate produces the desired disruption, but only in a well defined frequency range.

The alternating voltage is used solely as an oscillating electrohydrodynamical pressure source. It is this periodically varied pressure that produces the desired breakup. This device does not suggest a means for developing spray clouds of small droplets as in the spray triode. The Tsui/Hendricks paper, therefore, is non-applicable to the Spray Triode of the instant application.

Paint spraying at elevated voltages (70 KV to 100 KV), as seen in U.S. Pat. No. 3,512,502, is produced by rotating a sharp edged truncated cone maintained at high potential with respect to the grounded object to be coated. Paint is fed to the inside of the spray cone and is atomized as it leaves the sharp forward lip. Atomization proceeds by a combination of centrifugal and electrostatic forces.

A third electrode in the form of a small pointed cone is centrally located, i.e. is coaxially positioned and is approximately co-planar with the spray lip. A resistor is used to maintain this tip at a potential intermediate with respect to the spray cone and the grounded target. The device is a true Triode, the first thus far identified as prior art. However, a clear distinction between this device and the Spray Triode can be made insofar as the central third electrode is expressly used to control spray pattern geometry by altering the electrostatic field in the vicinity of the spray lip. Moreover, the central electrode is separated by an air gap from the spray lip. The conical third electrode does not contact the spray liquid directly as is the case in the instant application and contact is noted as to be avoided for correct operation.

The spray coating apparatus as seen in U.S. Pat. No. 3,700,168 is a coaxial device. Grounded spray liquid is radially flowed outward from a central supply tube toward a concentrically positioned electrode. High voltage is supplied to this electrode via a current limiting resistor. An air flow is maintained in the annular space between the inner liquid supply tube and the outer electrode support tube. The air flow, normal to the radially directed liquid flow, produces atomization and prevents collection of liquid on the high voltage electrode. It is stressed that collection of liquid on this electrode is deleterious to proper operation. This is clearly a diode, since the target is also at ground potential.

However, a coaxial, electrically floating cylinder has also been included in the description. It is the purpose of this cylinder to provide an electric field component to force the spray droplets out of the spray head which is encased in a cylindrical grounded enclosure. The patent proceeds to elaborate on this "driving" electrode and described a unique design that can be added to the gun to improve its spray pattern.

In place of the electrically floating cylinder a "driving" electrode charged to high potential by air-ion collection is detailed. The unique feature of this concept resides in the use of feed air stream kinetic energy to forcibly convert air-ions to the "driving" electrode. The kinetic energy of the air stream overcomes the retarding field of the "driving" electrode permitting high potentials to be attained at modest operating voltages. The "driving" electrodes is, therefore, charged by the equivalent of an air driven Van de Graaf generator.

Again the use of supplemental means for atomization, lack of emission from the electrode, and the absence of direct, forcible charge injection clearly distinguishes this device from the Spray Triode of the instant application.

A spray coating apparatus as seen in U.S. Pat. No. 3,587,967 is a Spray Diode. In addition, air is used to augment the atomization process. This device has coaxial geometry and uses a centrally positioned, sharply pointed high voltage electrode. Since the electrode is in air or in an air, droplet mixture, its function is not similar to the Spary Triode emitting electrode, therefore it cannot be cited as prior art.

The spray charging device as seen in U.S. Pat. No. 3,698,635 is a spray diode by virtue of the fact that two of the three electrodes used are at the same potential. In particular, the liquid feed tube and the target are both grounded. Liquid is fed through the innermost of three coaxial tubes. This feed tube is a dielectric in which a grounded electrode makes contack with the conductive spray fluid upstream from the liquid exit position. The liquid is forced radially outward from the end of the tubes. An enclosing concentric tube, also of dielectric material, supports a high voltage electrode coaxially in the vicinity of the liquid exit slot. This electrode is connected via a current limiting resistor to a high voltage supply. As liquid exits the inner tube, it is atomized partially by action of the electrostatic field produced by the high voltage electrode on the conducting spray fluid. Atomization is augmented by a high volumetric flow rate of air in the annular space defined by the two tubes. Liquid reisitivities as high as $1.3\times10^4$ ohmm are quoted as being sprayed by this device, a claim is made for $1.5\times10^5$ ohmm as the maximum resistivity level. The air flow is noted as being $10^3$ times that of the liquid. This high flow rates assures atomization and prevents liquid from accumulating on the high voltage electrode. Liquid contact with this electrode is noted as being inimical to optimal performance. The operation of this device is at 4 to 7 KV with an annular gap spacing of about ½ mm. The entire unit is enclosed in an open-ended grounded metallic cone. A second version of this device is also described. In this version liquid is coaxially flowed out of a 1.52 mm ID nozzle on the centerline. The end of this tubular nozzle is coaxial with a high voltage electrode and separated from it by an annular gap of ~0.9 mm through which air is forced. The indicated liquid flow rates were 0.83 to 4.67 ml/Sec with air flow again about three orders of magnitude higher (1420 ml/Sec). Indicated mean charge to mass ratios of $4.2\times10^{-3}$ C/kg at 0.83 ml/Sec and $2.0\times10^{-3}$ C/kg at 4.67 ml/Sec for this device place it in precisely the same performance category as the present apparatus. It should be noted that the instant invention attains the same charge levels but with a fluid some $10^9$ times more resistive and without need of an air flow. This spray unit is non-applicable to our patent application. It is noted that a third electrode can be added coaxially with the device and at its exit. It is the purpose of this electrode to help shape the spray geometry, i.e. to concentrate it in the forward direction. With this electrode in place, the unit is a spray triode but of the same type as represented in U.S. Pat. No. 3,512,502.

SUMMARY OF THE INVENTION

This invention relates to an electrostatic charging device and a process thereof for the formation of electrostatic charged droplets having an average diameter of less than about 1 millimeter for a liquid having a conductivity of less than about $10^4$ mho/meter, more preferably less than about $10^{-4}$ mho/m, most preferably less than about $10^{-10}$ mho/m, wherein the device includes a cell having a chamber disposed therein, a discharge spray means in communication with the cell, the liquid in the chamber being transported to the discharge spray means and atomized into droplets, and a mechanism for passing a free excess charge through the liquid within the chamber sufficient to generate free excess charge in the liquid within the chamber.

GENERAL DESCRIPTION

The electrostatic charging device of the instant invention includes a cell having a chamber therein with a discharge spray means disposed at one end of the cell, wherein the liquid to be atomized is disposed within the chamber and is emitted as charged particles from the discharge spray means. A charge which is sufficient to generate a free excess charge in the liquid is passed through the liquid within the chamber. The convective flow velocity of the liquid within the chamber is the same or different than the mobility controlled current flow velocity within the chamber thereby permitting the excess free energy charge to be effectively transported to the discharge spray means.

The current source usable for producing the charge means within the chamber of the cell can be a direct voltage, an alternating voltage, or a pulsed voltage source and mixtures thereof of about 100 volts to about 100 kilovolts, more preferably about 100 volts to about 50 kilovolts DC, most preferably about 100 volts to about 30 kilovolts DC. The charge induced into the liquid within the cell can be colinear or at an angle of intersection to the convective flow velocity of the liquid within the chamber, wherein the convective flow velocity of the liquid can be less than, equal to, or greater than the mobility controlled current flow velocity of the charge within the cell. The induced electrical charge introduced into the liquid within the cell must be sufficient to generate free excess charge in the liquid within the chamber, wherein the charge can be negative or positive.

The formed droplets exiting from the discharge spray means can be accelerated outwardly from the discharge spray means without any substantial stagnation, or emitted from the discharge spray means in a swirl configuration, or emitted from the discharge spray means in a planar configuration. The formation of the charged droplets can occur either within the spray discharge means or externally thereto.

Heating or cooling means can be provided for controlling the viscosity of liquid within the chamber of the cell, wherein the heating or cooling means can be a jacketed cell having a heated liquid oil or a refrigerant liquid disposed therein, or alternatively for the heat means convective hot air can be impinged on the cell or electrical heating elements embedded in the wall of the cell or disposed within the liquid within the chamber of the cell. The control of the viscosity of the liquid within the chamber of the cell could permit a wide range of materials to be employed as well as a means for controlling the flow rates of the liquids. Solutions of non-conductive liquids with solids or gases dispersed therein could be readily employed. A liquid pump means could be joined in a serial fluid communication to the cell for the creation of a positive pressure on the liquid within the cell thereby providing a means for the regulation of the flow rate.

A supply tank can be joined in a serial fluid communication to the electrostatic atomizing device by means of a conduit having a metering valve disposed therein.

A cleaning solution such as aromatic, cycloaliphatic, aliphatic, halo-aromatic, or halo-aliphatic hydrocarbon could be disposed and stored within the supply tank for subsequent atomization into a spray of fine droplets for the cleaning of a surface of an article disposed externally to the electrostatic atomizing device. For example, a surface of an industrial machine or an engine block caked with oil and grease could readily be cleaned with this device.

It is contemplated that an agricultural liquid such as an insecticide or protective fog agent could be disposed and stored in the supply tank for the subsequent formation into a spray of fine droplets which could be directed onto vegetation or soil for insect and pest control. This device could be readily mounted to a ground vehicle or even to an airplane for air spraying operation.

A lubrication oil could be readily disposed and stored in the supply tank for subsequent formation into a spray of fine droplets which would be readily adaptable for oil-mist lubrication of bearings and gears of large industrial machinery.

A solution of a plastic dissolved in a non-conductive liquid or an oil based paint could be readily disposed and stored in the supply tank for subsequent formation into a spray of droplets for impigment onto the surface of an article disposed externally to the discharge spray means thereby forming a coating on the surface of the article.

The present apparatus could be readily used to inject free excess charge into a molten plastic glass, or ceramic. If the plastic is rapidly cooled and solidified, a highly charged electret would be formed.

The cell of the electrostatic atomizing device could be joined in a serial fluid communication to a conventional plastic extruder, wherein a plastic material would be liquified under heat and pressure, transferred into the chamber of the cell and subsequently formed into a spray of charged droplets impingement of plastic on the surface of an article disposed externally to the cell thereby forming a coating on the surface of the article. Typical plastic materials could be selected from the group consisting of polyethylene, and copolymers thereof, polypropylene, polystyrene, nylon, polyvinyl chloride, or cellulose acetate or any other extrudable plastic material. Coal so extruded and heated could be atomized by this method providing a means to directly burn this material.

The spray discharge head of the electrostatic atomizing device could be disposed within a liquid which is disposed in a container that is externally disposed to the electrostatic atomizing device, wherein the charged droplets would be formed within the liquid. If a metal object which is oppositely charged to the charged droplets was disposed within the liquid the charged droplets would migrate through the liquid to form a coating on the surface of the metal article. An ideal application would be in the painting of metal objects such as automobiles, wherein the charged droplets are a paint.

Two electrostatic atomizing devices could each be joined in a serial fluid communication to a mixing vessel, wherein the first device would inject positively charged droplets into the mixing vessel and the second device would inject negatively charged particles into the mixing vessel thereby permitting an intimate mixing and neutralization of the positive and negatively charged droplets within the mixing vessel. The mixing of the negatively and positively charged particles with the mixing vessel could occur either in air or in a liquid disposed within the mixing vessel.

The charged liquid droplets from the electrostatic atomizing device can be readily sprayed onto an oppositely charged powder disposed externally to the device, wherein the powder can be disposed under agitation in a container or in the fluid bed. The charged droplets are coated onto the surface of the powder, wherein a neutralization of charge occurs. A typical possible application would be the coating of a perfume onto a talcum powder.

The charged liquid droplets from the electrostatic atomizing device can be readily sprayed onto the outer surface of an article which is oppositely charged to that of the charge of the droplets thereby causing a decharging by neutralization of the charged outer surface of the article. A typical example of this type of application would be the spraying of a large industrial tank which may have become electrostatically charged. Alternatively, the charged droplets could be injected into a liquid within the tank for subsequent decharging of the inner surface of the charged tank.

The electrostatic atomizing device could be joined in serial fluid communication to a liquid pump means disposed within a hand held aerosol generator, and a liquid supply tank would be detachably secured to the hand held generator and would be in serial fluid communication with the liquid pump means. A magnetoelectric generator means would be disposed within the hand held generator, wherein said generator means would generate the electrical charge to be induced into the liquid with the cell. An activation means such as a trigger assembly would be disposed within the hand held device for the simultaneous activation of the generator means and the liquid pump means. This assembly could be readily employed as a replacement for aerosol cans.

The difficulty of obtaining efficient combustion of hydrocarbon fuels can be readily overcome be decreasing the size of the formed droplets thereby providing increased surface area for combustion and consequently improved efficiency of heat transfer. The formation of droplets having a diameter of about 1 micron to about 1 millimeter, more preferably about 2 to about 50 microns permits the spray of fuel into the combustion chamber to be uniformly dispersed. The electrostatic atomizing device of the present invention would be readily adaptable for delivery of a fine spray of hydrocarbon fuel such as No. 2 heating oil to the combustion chamber of domestic and industrial oil burners. Additionally, the electrostatic atomizing device can be charged with gasoline for subsequent atomization into a gasoline spray for injection indirectly into an internal combustion engine through a carburetor or directly into the head of an internal combustion engine such as an Otto, Diesel, or Brayton. These oils and gasolines have extremely low ohmic conductivities on the order of about $10^{-13}$ to about $10^{-6}$ mho/meter, more preferably about $10^{-6}$ to about $10^{-12}$ mho/meter most preferably about $10^{-8}$ to about $10^{-12}$ mho/meter. Heretofore, the ability to atomize these fuels into electrostatic charged particles has been limited by the inability to effectively create an excess free charge within the liquid thereby preventing the formation of particles having a diameter of less than about 50 microns at commercially acceptable flow rates.

BRIEF DESCRIPTION OF THE DRAWINGS

For a more complete understanding of the instant invention, reference is made to the accompanying drawings, in which.

DESCRIPTION OF THE PREFERRED EMBODIMENTS

Figure 1:
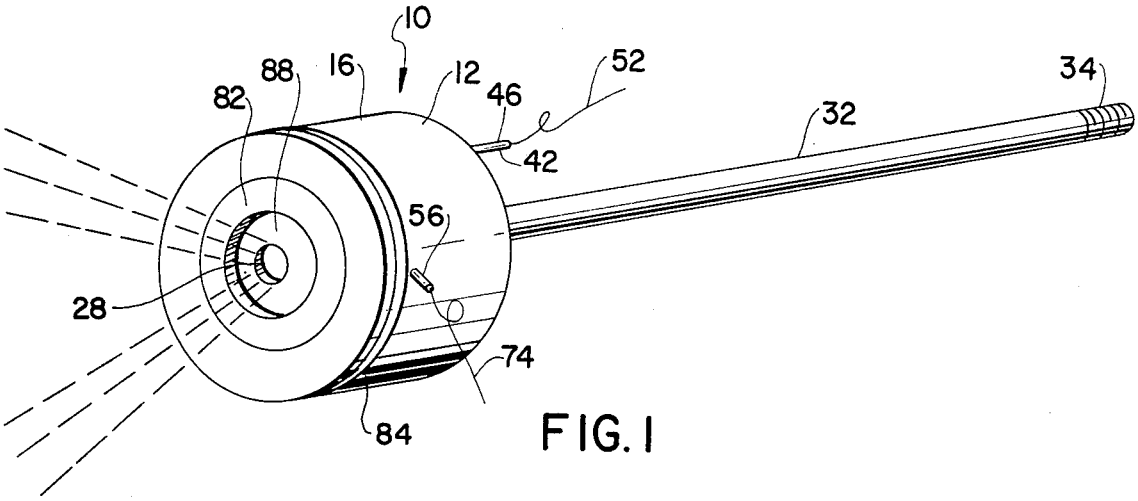
FIG. 1 illustrates a perspective view of a first embodiment of an electrostatic atomizing device.
Figure 2:
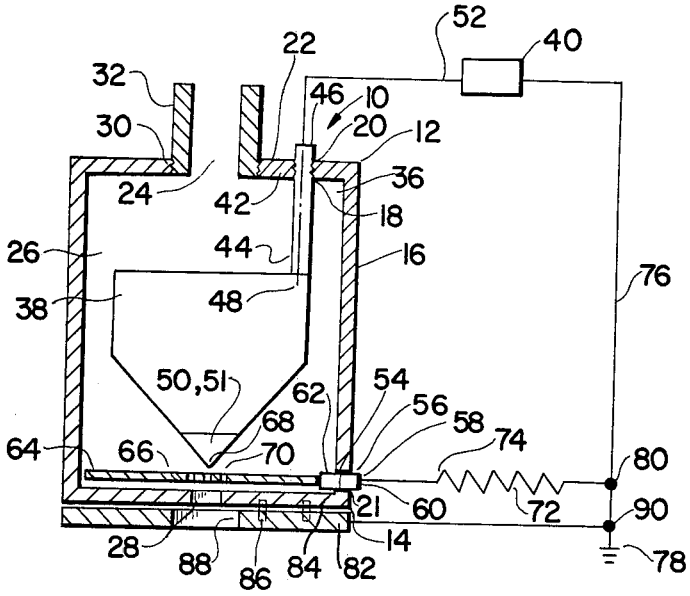
FIG. 2 illustrates a cross-sectional view of an electrostatic atomizing device.

Turning now descriptively to the drawings, in which similar reference characters denotes similar elements throughout the views of the different embodiments, FIGS. 1, 2 show a first preferred embodiment of an electrostatic atomizing device 10 which includes a cylindrically shaped non-conductive housing (cell) 12 (e.g. Lucite) having a base 14, an upwardly extending cylindrically shaped sidewall 16 with a threaded aperture 21 therethrough, a top 22 with a threaded aperture 20 therethrough and a threaded hole 24 therethrough, and a chamber 26 disposed therein, wherein the base 14 has a center discharge opening 28 therethrough which is the discharge spray means. One threaded end 30 of a first cylindrically shaped liquid supply conduit 32 is threadably received into hole 24, wherein the conduit 32 extends linearly outwardly from the top 22 of the housing 12. The other threaded end 34 of conduit 32 is adapted to be joined to a liquid supply means (not shown) whereby the liquid passes through conduit 32 into chamber 26, wherein the liquid has a conductivity of less than about $10^{4}$mho/meter, more preferably less than about $10^{-4}$mho/meter, and most preferably less than about $10^{-10}$mho/meter, e.g. No. 2 grade heating oil. A first non-conductive elongated cylindrically shaped tube 42 having an externally threaded surface 18 and a continuous bore therethrough is threadably disposed through threaded aperture 20, wherein one end 46 of tube 42 extends outwardly from housing 12 and the other end 48 of tube 42 extends inwardly into an upper portion of chamber 26. A first electrode 38 or a series of first electrodes 38 in parallel or in a parallel series combination is joined into the end 48 of tube 42 by suitable means such as an adhesive cement or the end 48 of tube 42 can be embedded into electrode 38, wherein electrode 38 has a setaceous surface 50 formed from a plurality of pins 51 which are in a substantially parallel alignment within the chamber 26. A setaceous surface is defined as one having a plurality of essentially parallel similar continuous pins having lateral dimensions of order 10 μm, more preferably1 μm, most preferably 0.1 μm or less in a matrix of non-conductor or semi-conductor material. Each pin is arrayed in a regular or almost regular pattern with mean separation distances of an order of about 35 μm or less. An example of a suitable electrode 38, but not limiting in scope, is a eutectic mixture of uranium oxide and tungsten fibers as described in Journal of Crystal Growth 13/14, 765, 771 (1972) "Unidirectional Solidification Behavior in Refractory Oxide Metal Systems," A. T. Chapman, R. J. Geides. The first electrode 38 is connected in series to a high voltage source 40 which is disposed externally to the housing 12, by means of a first electrical lead wire 52 extending through the bore 44 of tube 42. The high voltage source 40 is wired by means of a ground wire 76 to a ground 78 disposed externally to device 10. A second non-conductive e.g. Lucite) elongated cylindrically shaped tube 56 having a continuous bore 58 therethrough is disposed through aperture 21, wherein one end 60 of tube 56 extends outwardly from housing 12 and the other end 62 of tube 56 extends inwardly into a lower portion of chamber 26. A liquid tight seal is formed between tube 56 and widewall 16 by adhesive or other sealant means 54. A second electrode 64 or a series of second electrodes 64 in parallel or in series parallel combination are joined onto end 64 of tube 56 by suitable means such as an adhesive cement or the end 62 of tube 56 can be embedded in electrode 64. The second electrode 64 is a planar shaped disc 66 having at least one center longitudinally aligned aperture 68 therethrough and optionally a plurality more of longitudinally aligned apertures 70 therethrough at prescribed distances from the center aperture 68; alternately a plurality of longitudinally aligned apertures 68 could be used arrayed symmetrically with respect to the center line with no aperture hole on the center line. The aperture holes could also be skewed to the center line. The second electrode 64 is disposed transversely within chamber 26 below and spaced apart from the first electrode 38. Electrode 38 can be moved longitudinally upwardly or downwardly thereby reducing or increasing the gap between the electrodes 38, 64 as well as modifying the flow of charge within the liquid. The second electrode 64 is preferably formed from platinum, nickel or stainless and is wired in series to a high voltage resistor element 72 disposed externally to housing 12 by an electrical lead wire 74 extending through tube 56. The resistor element 72 is connected at its opposite end to ground juncture 80 of the high voltage source 40. An external annularly shaped electrode 82 (e.g. stainless steel) can be affixed on the external bottom surface 84 of base 14 by adhesive means or by a plurality of anchoring elements 86 extending upwardly through electrode 82 and being embedded into base 14. The center opening 88 of electrode 82 and discharge opening 28 are aligned, wherein opening 28 is preferably less than about 2 cm in diameter, more preferably less than about 1 cm in diameter most preferably less than about 6 mm microns in diameter, and the diameter of the center opening 88 is less than about 1 mm, more preferably less than about 600 μm, and most preferably less than about 200 μm. In this position, electrode 82 assists the spraying due to the development of the electrostatic field; however, the positioning of electrode 82 at this position is not critical to operation as long as this electrode 82 is disposed external to housing 12. The electrode 82 is also connected to a second grounded junction 90 disposed between ground 78 and the first electrical juncture 80. The first electrode 48 is negatively charged wherein the second electrode 64 has a relative positive potential with respect to the first electrode 38 and the external electrode 82 is at ground potential (the positive potential of source 40). In one mode of operation the first electrode 38 is negatively charged at the second electrode 64 and the external electrode 82 are relatively positively charged. The high voltage source 40 which can be a direct voltage, an alternating voltage, or a pulsed voltage source of either polarity, wherein the source is about 100 volts to about 100 kilovolts, more preferably about 100 volts to about 50 kilovolts DC, and most preferably about 100 volts to about 30 kilovolts DC. The charge induced into the liquid 36 within the chamber 26 results in a flow from the first electrode 38 to the second electrode 64. The liquid within the chamber 26 flows towards the discharge opening 28 of the base 14, wherein the electrical charge which is induced into the liquid within the chamber 26 must be sufficient to generate excess free charge in the liquid within the chamber 26, wherein the charge can be positive or negative. The liquid is emitted outwardly thereform in a spray configuration, (as a plurality of droplets 92), wherein the external electrode 82 enhances acceleration of the charged droplets 92.

Figure 3:
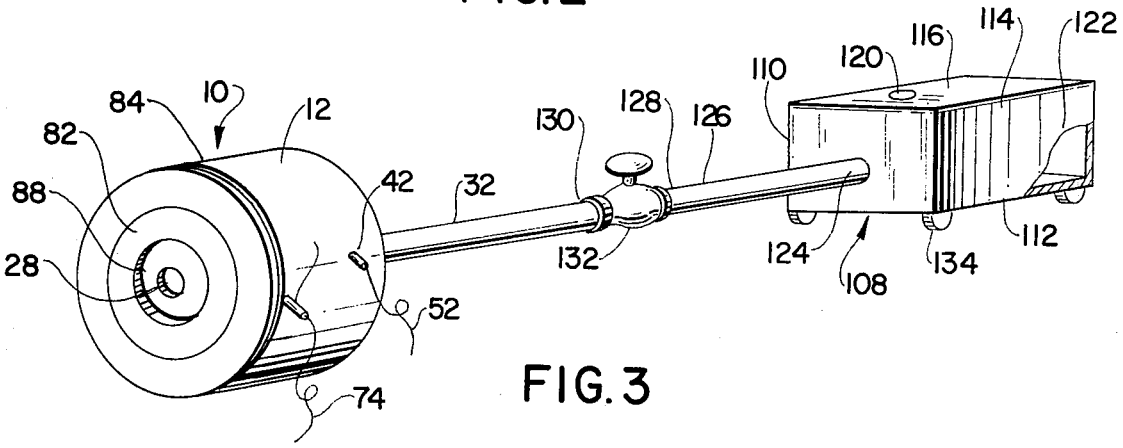
FIG. 3 illustrates a perspective partially cutaway view of the electrostatic atomizing device in a serial fluid communication with a supply tank.

FIG. 3 shows the electrostatic atomizing device 10 in a serial fluid connection to a supply means 108 which includes a tank 110 having a base 112, a plurality of upwardly extending walls 114, a top 116 with a threaded opening 120 therein, and a chamber 122 therein, wherein the liquid to be atomized is stored within chamber 122. One end 124 of a second cylindrically shaped liquid supply conduit 126 extends through one of the walls 114 of tank 110. The other end 128 of conduit 126 and the other end 130 of conduit 32 are joined in a serial fluid communication to a liquid valve means 132. A plurality of wheel members 134 can be affixed to the base 112 of tank 110 thereby improving mobility of the device 10.

Figure 4:
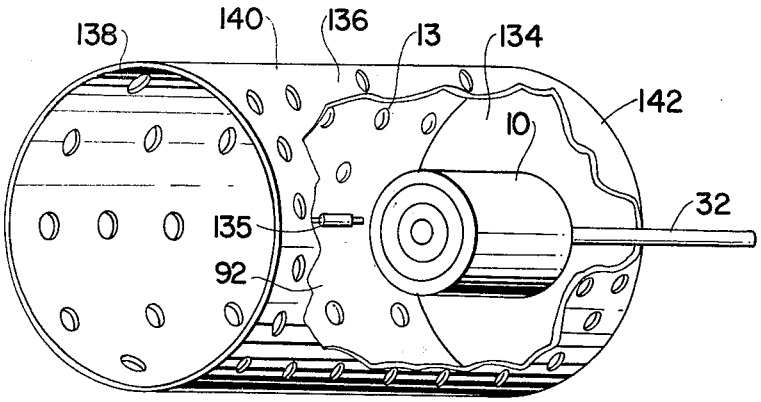
FIG. 4 illustrates a perspective partial cutaway view of the electrostatic atomizing device in combination with a combustion burner device.

FIG. 4 illustrates the electrostatic atomizing device 10 disposed in the chamber 134 of a cylindrically shaped combustion burner device 136 having an open end 138 a cylindrically shaped sidewall 140, and a top 142, wherein conduit 32 extends through top 142 and the spray of droplets 92 formed within chamber 134 are mixed with air and subsequently ignited with the combustion zone of the chamber 134 by means of a suitable igniting means 135 such as a spark plug. The air is supplied into chamber 134 by standard fan or compressor means. The sidewall 140 can also have a plurality of air inlet apertures 13 therethrough for supplemental injection of air into chamber 134.

Figure 5:
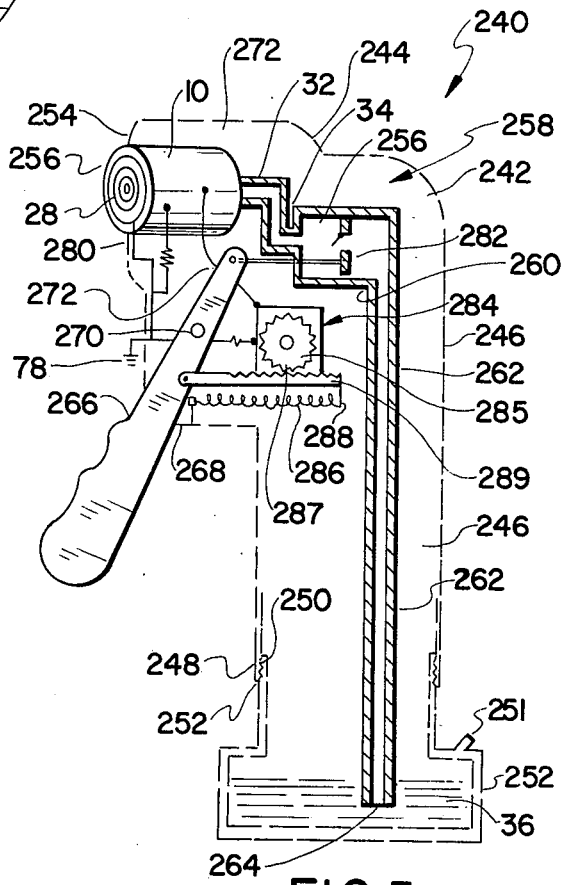
FIG. 5 illustrates a side partially cutaway view of the electrostatic atomizing device joined in a serial fluid communication with a hand actuating device.

FIG. 5 shows the electrostatic charging device 10 joined in communication with a hand activating device 240. The hand activating device 240 includes a cylindrically shaped housing 242 of an L shaped configuration having shorter 244 and a longer 246 legs, wherein the open end 248 of the longer leg 246 is internally threaded and is adaptable for threadably receiving the externally threaded neck 250 of a bottle 252 having a vent 251 therein which is adapted for receiving liquid 36 therein. The closed end 254 of the shorter 244 has an opening 256 therethrough, wherein the device 10 of the first embodiment as depicted in FIGS. 1, 2, 6 or 7 extends therethrough with the discharge opening 28 of device 10 being disposed externally to housing 242. The end 34 of conduit 32 is joined in serial fluid communication with a liquid pump means 256 disposed within housing 242 at the juncture 258 of legs 242, 246. One end 260 of elongated liquid supply conduit 262 is in serial fluid communication with liquid pump means 256, wherein conduit 262 extends linearly through leg 246 with the other end 264 extending outwardly from open end 248 and adapted to be recieved into the liquid 36 disposed in bottle 252. A bore conductive tigger means 266 extends through the sidewall 268 of leg 244 wherein the tigger means 266 is disposed on a pin 270 are journalled for rotation in the inner surface of sidewall 268 of leg 244. The inner end 272 of tigger means 266 is joined to the stem rod 280 of the piston 282 of liquid pump means 256. A magnetoelectric generator means 284 with a drive shaft 287 is disposed with chamber 272 of housing 242, a pinion gear 285 is disposed on shaft 287. A rack gear 289 is joined to tigger 266 and meshes with gear 287 such that movement of tigger 266 causes activation of generator means 284. The generator means 284 functions as the high voltage source 40 of the device 10 as depicted in FIGS. 1, 2, 6, or 7. A return spring member 286 communicates between the tigger means 266 and an anchor element 288 disposed on the inner surface of sidewall 268 of leg 244. In operation, when the tigger means 266 is activated pump means 256 pumps liquid 36 into chamber 26 of device 10 as the electromagneto means 284 delivers a high voltage current to the first electrode 38.

Figure 6:
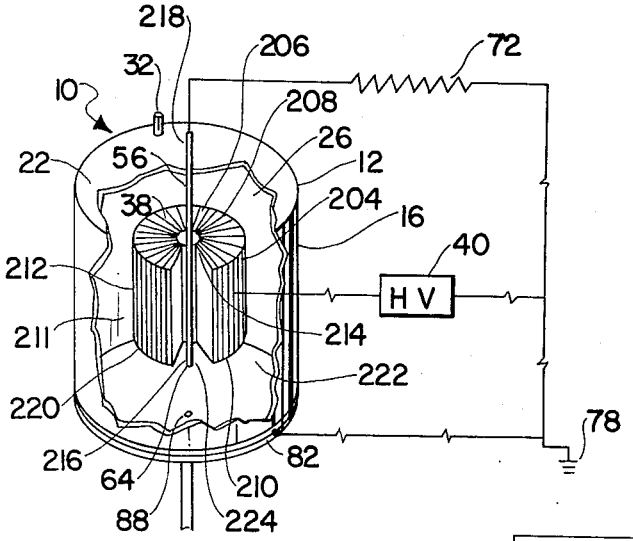
FIG. 6 illustrates a side cross sectional view of a second embodiment of the electrostatic atomizing device.

FIG. 6 shows a second embodiment of the electrostatic charging device 10, wherein the modification from the first embodiment of device 10, includes the design and positioning of first 38 and second 64 electrodes within the chamber 26. The first electrode 38 includes a cylindrically shaped conductive plug 204 having a longitudinally extending bore 206 therethrough, wherein bore 206 extends from an upper 208 to a lower end 210 of plug 204. The surface 211 of bore 206 is formed from a plurality of sharp-edged longitudinally, close-spaced riges 212. The second electrode 64 is an elongated cylindrically shaped member 216 disposed within the bore 206 of plug 204, wherein tube 56 affixed linearly to one end 214 of member 216 extends linearly upwardly through a liquid tight aperture 218 within top 22 of device 10. The plug 204 can be formed from a plurality of razor blades stacked and adhesively secured together in the desired cylindrical shape. The outer cylindrically shaped sidewall 220 of plug 204 is secured by adhesive means 222 to the inner cylindrically shaped surface of sidewall 16 of housing 12 thereby causing the liquid disposed within the chamber 26 to flow downwardly through the annular gap 224 defined by bore 206 and member 216. The flow of charge between the electrodes 38, 64 is perpendicularly to convective flow of liquid within the annular gap 224.

Figure 7:
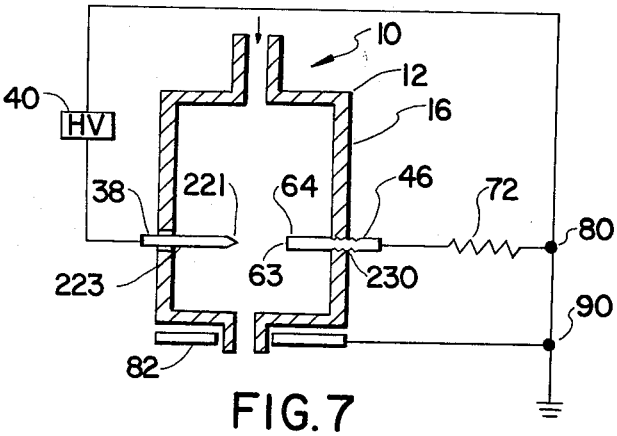
FIG. 7 illustrates a side cross sectional view of a third embodiment of the electrostatic atomizing device.

FIG. 7 shows a third embodiment of the electrostatic charging device 10, whereby the modification from the first embodiment of device 10 includes the positioning and design of the first 38 and second 64 electrodes within the chamber 26. The first electrode 38 consists of an elongated rod 223 with a sharp tipped end 221, wherein rod 223 extends transversely through the sidewall 16 of housing 12. Tube 46 is joined to electrode 64 and tube 46 extends through an opening 230 in sidewall 16 of housing 12 and is adhesively secured therein, wherein the blunt face 63 of electrode 64 is longitudinally aligned within chamber 26. Rod 223 can be moved so as to adjust the gap between surface 221 of electrode 38 and electrode 64 within the chamber 26. The end 221 of the first electrode 38 is disposed within chamber 26 and is disposed transversely across from electrode 64 within chamber 26. Depending on the positioning of the first electrode 38 relative to the stationary second electrode 38 within the chamber 26, the gap distance between the electrodes 38, 64 can be readily varied as well as the angle of intersection of the flow charge within the chamber 26 relative to the flow of liquid 36 within the chamber 26. Alternatively, it is fully contemplated within the scope and spirit of the invention that the second electrode 64 can be made longitudinally movable within the chamber 26.

EXPERIMENTAL RESULTS OF THE VARIOUS PREFERRED EMBODIMENTS OF THE INVENTION

The following examples are intended to provide sufficient experimental data for a complete understanding of the instant invention but is not to be construed as eithr limiting the spirit or scope of the invention.

EXAMPLE 1

An extensive series of tests involving Spray Triode configurations similar to that depicted in FIGS. 1, 2 were conducted. The purpose of these tests were twofold:

1. To map the terminal characteristics of Spray Triode operation as a function of internal geometry, flow rate, voltage and resistance level, and
2. To maximize mean specific charge (mean spray charge to mass ratio), i.e. to minimize mean spray droplet size.

Negative high voltage was applied to the centrally located emitting electrode 38 (FIG. 2). Electrode 38 was movable along its axis permitting its relative position with respect to the blunt electrode 64.

For the majority of tests electrode 38 consisted of a 3 mm diameter stainless steel rod surmounted by a 2 mm thick segment of uranium oxide, tungsten composite setaceous surface. The terminal end 50 to which the uranium oxide tungsten emitting surface was brazed, was ground to a conical configuration whose axis was coincident with the centerline of the stainless steel support stem and the device proper. Total included cone angles of from 120° to 60° were successfully operated. The data to be discussed were collected with a 60° C. one corresponding to an emitting surface (the setaceous surface) having a conical base diameter of 1.5 mm and a height of 1.1 mm. The setaceous electrode material in this test sequence had $\sim 2 \cdot 10^7$ tungsten pins each $\frac{1}{2}$ μm in lateral extent, oriented parallel to the stem centerline and distributed uniformly and almost regularly across the surface.

The presence of small conducting pins served to enhance the local electric field in the pin's immediate vicinity and to facilitate charge emission from the metal into the spray fluid. The setaceous surface so acted as a field emitter of negative charge under action of the electric field developed by the voltage differential applied between this electrode 38 and the blunt electrode 64. Initial operation was obtained with etched, free standing tungsten pins. Etching preferentially removed the uranium oxide matrix exposing the tungsten single crystal pins. These pins 51 were about 5 μm long and were selectively etched to sharp points at their terminal ends. It was the purpose of this sharpening process to enhance the electric field magnification factor at the pin tips.

Electric field enhancement at the emitting tips is a characteristic feature of Spray Triode operation. Electric field enhancement due to small radius of curvature emitting regions permits the development of high field strenghts at the emitter pins while maintaining a very much lower electric field strength in the bulk of the fluid in the interelectrode gap. In this way, when sufficient voltage is applied to cause field emission from the surface the free electrons are released into a region in which their mobility velocity is low in accordance with the low interelectrode field strength.

Spray Triode operation for periods of ~½ hour was found to effectively erode the pins 51, leaving short nubs (1 μm) or in some instances removing the tungsten to positions below the mean surface of the electrode. Despite this no gross degradation of Spray Triode operating behavior was observed during the course of this reduction process. For all intents and purposes, the shortened pins 51, because of their small lateral dimensions, produced field enhancement comparable to their initial, elegantly sharpened configuration. On the basis of this observation, the bulk of testing was conducted with ground and polished composite structures. No subsequent provision was made to provide free standing pins. Operation of individual examples of composite, setaceous emitting surfaces for tens of hours revealed no pattern of degradation, with day to day reprocibility of 10% typical.

A variety of blunt electrodes 64 were used during the course of this work. Typically, these electrodes were fabricated from 250 μm thick (0.010″), 304 stainless steel sheet. The detailed results to be discussed were obtained with a blunt electrode having a single 200 μm diameter (0.008″) hole 68 concentrically placed with respect to the emitting electrode centerline. The blunt electrode 54 was connected to ground via a high resistance (R) 72. The majority of tests were conducted with a 1000 meg Ω resistor. Other resistance values up to 5000 meg Ω were tested and provided acceptable operation. Multihole blunt electrodes 64 were tested and worked well. In particular, three 200 μm holes equispaced 500 μm apart and four 156 μm holes in a 250 μm square pattern were successfully run.

Both the emitting electrode 38 and the blunt electrode 64 were mounted in a lucite head 31.8 mm in outside diameter and 11.51 mm in inside diameter. Various inserts 11.46 mm outside diameter, 65.3 mm inside diameter were used to vary the amount of swirl imparted to the spray fluid as it entered the Spray Triode from two diametrically opposed entrances provided for this purpose. The presence of swirl did not significantly alter the electrical characteristics of the Spray Triode. It did, however, provide enhanced fluid disruption in the absence of an impressed electric field and, therefore, will be of importance for applications where droplet generation in the absence of applied voltage is important.

In the tests to be described, a no-swirl insert having radial passages connecting the inlet ports to the interelectrode charge injection volume was employed. The resultant exit stream from the 200 μm diameter exit port hole 68 in blunt electrode 64 had a glassy, rod-like appearance with occasional breakup into a co-linear stream of droplets 200 μm in diameter occurring ~10 cm downstream of the blunt electrode. This breakup occurred under the action of random mechanical vibration which was intermittantly present in the test apparatus.

The third electrode 82, was electrically connected to a cylindrical collection receptacle configured and positioned to intercept all of the dispersed spray. Both 82 and the collection electrode formed a single unit electrically—at ground potential.

Terminal behavior of the Spray Triode device, i.e. current to the emitting electrode 38 and from the blunt electrode 64 and collector electrode 84 as a function of impressed voltage ($V_a$) for various electrode gap spacing(s) and flow rates Q were obtained. A small gear pump capable of supplying up to 10 ml/Sec at pressures up to 1000 KPa was used in conjunction with filters (10–13 μm), an accumulator to smooth pump induced pressure pulsations, ball float flow meters to monitor flow rate and suitable valves to provide control comprised the flow system used to circulate the spray fluid during testing.

In all instances, a highly refined paraffinic white oil was used in the tests. This oil, Marcol 87, is defined in Table I.

Continued use of the same oil for extended periods of time (months) resulted in very modest alteration of the physical properties from those noted in the table for fresh oil. After about two months of daily operation ohmic conductivity was found to have increased from $0.3\times10^{-12}$ mho/m to $0.9\times10^{-12}$ mho/m. When tested after 6 months of operation ohmic conductivity had increased to $1.6\times10^{-12}$ mho/m. In all instances, these values of ohmic conductivity were deemed sufficiently low as to permit neglect of the observed temporal variation.

Testing was conducted in a cylindrical (35 cm diameter) enclosure purged with a continuous stream of nitrogen. To obviate the possibility of inadvertent droplet spray combustion, the enclosure oxygen content was maintained below 5% for all testing.

Spray Triode operation with a combinaton of DC voltage plus a variable AC component revealed that under all conditions studied (alternating voltages having frequencies in the range 15 to 1200 Hz and amplitudes up to the DC level ~10KV) poorer charge injection and lowered mean specific charge, as compared to DC performance, resulted. Consequently, all testing was conducted using a DC power supply. A NJE general purpose 0 to 30 KV high voltage power supply was used for all tests. Two 0.02 μf high voltage capacitors in parallel were used to reduce ripple at operating voltage from ~80 V P-P to ~10 V P-P.

Additional tests conducted on this embodiment were designed to: (1) optimize Spray Triode performance (i.e. maximize mean observed specific charge), and (2) develop a data base from which a detailed understanding of Spray Triode operation could be developed.

Volumetric flow rate ($\dot{Q}$), A-B electrode spacing(s) and applied voltage ($V_a$) were systematically varied during these tests. Operating temperature was fixed at 25±½°0 C. With the exception of one test sequence conducted using a $5\times10^9$ resistor 72 between the blunt electrode 64 and ground 79 all data were otherwise obtained with a $10^9$ value for this resistor 72. No measurable dependence of spray behavior upon resistance level, in the range noted, was observed. This was taken as justification for the elimination of this parameter from detailed study.

In accordance with Ostroumov's observation that for laminal flow (a situation that exists in this experiment) field emitted space charge limited current is cubically dependent upon impressed voltage differential, all data were plotted as $I^{1/3}$ vs. voltage differential. A cubically related I,V characteristic would plot as a straight line. Graph I represents one set of data obtained at a fixed flow rate of 1.05 ml/Sec. A separate curve is present for each of the three interelectrode gap spacings tested. A similar set of data was obtained for each of the four flow rates studied (0.43, 0.60, 0.83 and 1.05 ml/Sec).

The bi-linear behavior of the data is readily apparent. This is a feature exhibited by the Spray-Triode at all flow rates tested, when using $UO_2$/W setaceous emitting electrodes. Within experimental error of ≠10% current ($\sim\pm3\%$ in $I^{1/3}$), the data are linear, i.e. current is cubically dependent upon voltage, both below and above the breakpoint. Data obtained at voltage above the breakpoint are somewhat more scattered than that at lower voltages, but are consistent with a cubical I,V relatinship.

The data can be correlated in terms of space change free electric field strength at the emitting electrode tip. Using the derivation of Jones for electric field strength in the vicinity of a hyperboidal point the data support interpretation of emission occurring from a 34 μm radius region on the electrode centerline. This is consistent with the observed tip geometry after a period of operation wherein the initially sharply pointed conical tip has been eroded to a stable, equilibrium configuration (cone plus hemispherical cap). Use of this value for tip radius and the relationship presented by Jones permitted the voltage differential to be interpreted in terms of tip electric field strength. The data of Graph I have been replotted in terms of tip field strength as shown in Graph II. The three data curves of Graph I obtained at various interelectrode gap spacings, have coalesced into a single curve on the $I^{\frac{1}{3}}$vs. $-E$ plot ($-E=10^{-7}\times E_{TIP}$). Again the cubical nature of the emission behavior is clearly evident. A feature common to all $I^{\frac{1}{3}}$vs. $-E$ plots independent of flow rate.

Similar behavior is exhibited by the data when plotted as *$(Q/M)^{\frac{1}{3}}$vs. $-E$ cf Graph III. Not unexpectedly the data support a bimodel cubical dependence of observed means specific charge on applied emitter tip field (and/or voltage differential).

The breakpoint, defined as the intersection of the two linear portions of the $(I_b+I_c)^{\frac{1}{3}}$vs. $[-(V_a-V_b)]$, $(I_b+I_c)^{\frac{1}{3}}$vs. $-E_{TIP}$ or *$(Q/m)^{\frac{1}{3}}$vs. $E_{TIP}$, within the limits of experimental error, occurs at the value of voltage differential (or equivalently the space charge field free electric field at the emitting tip) where measurable current is first observed from the blunt electrode. For voltages below the breakpoint current from the blunt electrode ($I_b$) is in the noise level of the experiment, i.e. <1na.
*Note: $I_c/\dot{m}=Q/M$ Above the breakpoint $I_b$ was found to depend cubically on voltage differential. The blunt electrode 64 collected current under all test conditions accounted for less than 26% of the total emitted current.

Analysis of the least square fit straight lines through the $(I_b+I_c)^{\frac{1}{3}}$vs. $-E$ data revealed the following correlations:

1. Slopes of the initial, low voltage lines decreased modestly with increasing flow rate. However, the slopes for all flow rates studied were equal to $1.45\times10^4$ $AMP^{\frac{1}{3}}/V/m$ with a standard deviation of 4.3%.

2. Closely similar behavior was exhibited by the slopes of lines correlating the data taken at voltages above the breakpoint.

3. The slopes of the two linear portions of a given data set taken as fixed flow rate were found to be correlated. The ratio of the initial to high voltage slopes equal 1.935 with a standard deviation of 3.0%. No correlation with either flow rate or gap spacing was observed.

*NOTE: $I_c/\dot{m}=Q/M$

Analysis of the maximum attainable electric field strength (computed as space charge free) at the emitting tip (i.e. the electric field strength corresponding to the highest sustainable voltage differential in the absence of breakdown) revealed a linear dependence on flow rates ($\dot{Q}$, ml/Sec), viz, $E_{TIP}/\text{max.}=-(6.89+8.59\ \dot{Q})\times10^7$ V/M, with a coefficient of determination, $r^2=0.966$. Within experimental error this relation is independent of gap spacing over the range studied indicating fluid velocity and fluid properties are the sole factors influencing maximum sustainable electric stress. The higher the velocity in the emitting tips vicinity the higher the maximum electric field.

For all data collected the breakpoint electric field $E_b$ was found to be a fixed fraction of the maximum sustainable electric field. The existence of a fixed proportionality (0.52 with a standard deviation of 8.5%) indicates a common mechanism exists underlying the behavior of Spray Triode operation.

A model of Spray Triode operation can be inferred from these data. As the voltage differential is increased (at fixed gap spacing and flow rate) emission starts to occur at the emitter electrode 38 tip. Free electrons are injected into the spray fluid. Upon leaving the immediate vicinity of the emitting pins 51 in the setaceous surface 50 of electrode 38 the electrons, whether attached or free or intermittantly bound, start to drift toward the blunt electrode 64. Drift velocity is controlled by the electronic mobility m and the mean electric field in the (38)–(64) gap region.

During low voltage differential charge injection the bulk fluid velocity is sufficiently high to prevent the injected charge from reaching the blunt electrode. Coaxial placement of the emitter electrode and emission from the tip region insures that the freed charge will be introduced into the high velocity "core" of the exiting viscous flow.

As the potential differential is increased emission density increases. This leads to an increase in the space charge field (or counter field) and to an increase in the space charge induced pressure in the bulk fluid. The electric field pattern in the vicinity of the emitter tip is thus altered. The tip is shielded from the impressed field by the space charge field of the emitted charge. The net result is a broadening of the emission region with other portions of the emitting tip becoming active. This, coupled with the altered electric field, introduces free charge into regions of the flow pattern further from the initial high speed "core" region. Added to this is the electrostatic pressure produced flow field alteration. The overall effect of these processes is to distort the free charge trajectories outward from the vicinity of the emitting tip.

A higher impressed mean electric field will produce increased mobility velocity at the same time the outwardly displaced charge encounters flow velocities which are reduced from those in the fluid streams "core." A point is reached, with increasing voltage, where the electron trajectories are sufficiently distorted from their initial configuration to encounter the blunt electrode.

The data indicate that the ratio of mobility velocity ($V_m$) at the breakpoint to mean bulk velocity ($V_b$) is inversely related to the mass flow rate $\dot{Q}$. With a coefficient of determination of 0.89 and assuming a constant mobility $\mu=1.3\times10^{-7}$ $m^2/V.Sec$; $V_m/V_b=0.186+0.146/\dot{Q}$. This empirical relation agrees to within 2% with that derived using the empirical relation for $E_{max}$ as a function of Q and a fixed ratio of 0.52 between $E_b$ and $E_{max}$. Over the range of flow rates studied and for the geometry used mobility velocity has to be from two to five times lower than the bulk fluid velocity to prevent collection of current by the blunt electrode 64.

With the establishment of current paths to the conducting blunt electrode 64 the breakpoint is past and current paths continue to broaden with further increase in voltage.

This "model" of Spray Triode operation is reinforced by analysis of spray, collected current ($I_c$) data. Because droplet size is correlated with mean specific charge (defined as $Ic/\dot{Q}$) the data were plotted as shown in FIG. 3 as $(Q/M)^{1/3}$ vs. $-E$. Evaluation of those data revealed the following:

1. Maximum observed mean specific charge was equal to $2.48\times10^{-3}$ C/kg with a standard deviation of 5.8% independent of flow rate or gap spacing. 2. Below the breakpoint $I_b$ O, therefore $I_c$ (i.e. $Q/M\cdot\dot{Q}$) and total emitted current are identically related to E; viz, the same cubical dependence prevails as observed with total emitted current. 3. As a corollary to 2 the same relation between $E_b$ and Emax was obtained. The Q/M data yielded a value for this ratio within 1% of the 0.52 value determined from total current data. 4. Above the breakpoint the collected current is less than the total emitted current (i.e. $I_b\neq0$). Therefore, the slope of the data line is less than that observed for the emitted current, (total emitted current)$^{1/3}$ vs. E data. Whereas the ratio of the slopes, i.e. the ratio of the initial to high voltage slope was 1.935 for the emitted current, the corresponding ratio for the collected current $I_c$ was 2.234 (standard deviation of 4%) or some 21% less. Therefore, space charge more severly alters the means specific charge than it does the total emitted current.

The implications of these results are clear. For fixed flow rate mean specific charge increases cubically with voltage differential (or equivalently with space charge free calculated emitter tip E field) until the onset of breakdown. It has been established that limiting tip E field is linearly dependent upon flow rate, the higher the mean flow rate (or fluid velocity for fixed exit port size) the higher the equivalent E field at which breakdown will occur. However, within the range of flow rates tested, the limiting condition is characterized by fixed mean specific charge.

were arranged so as to define a cylindrical surface 4.75 mm inside diameter. Approximately one meter total length of emitting edge surface was exposed on the inside surface. The blade segments were epoxied to form a coherent unit with the edges exposed and clear of epoxy. One or more circumferential grooves were ground into the outside epoxy surface of the blade unit. The groove(s), filled with wound copper wire, electrically conducting epoxy or a combination thereof, assured electrical communication existed between all blades of the unit. Precise mating of 220 with the spray chamber was assured by grinding the top and bottom ends of smooth, parallel and perpendicular to the chamber centerline.

Electrical contact with the electrode 38 was made by a bolt contacting the razor electrode unit and holding it in place within the chamber 26. The bolt passed through the Lucite casing and protruded on the outside where contact to the high voltage power supply 40 was made. The emitter exit plane was within 1.4 mm of the 1 mm exit port entrance.

The electrode 64 was coaxially positioned with respect to the emitter electrode 38 as shown. Numerous different blunt electrodes 64 were successfully used. All electrodes were 3.18 mm diameter (⅛") and extended to the exit port entrance. Both brass and stainless steel solid rods were used as electrodes in early tests. In addition, a hollow rolled stainless steel screen electrode 64 was also successfully used. In fact, most data were obtained using this type of electrode structure. Tests of various surface materials were conducted with this electrode. In addition to the base stainless screen data were obtained with nickel, gold and platinum plating. Spray performance correlated positively with increasing blunt electrode work function.

Tests were conducted using resistance (R) values from 100 megΩ to 5000 megΩ with the bulk of testing being conducted with R 1000 megΩ. In all instances, Victoreen high voltage resistors ±1%±5%, tolerance

TABLE I

PHYSICAL CHARACTERISTICS OF EXXON MARCOL 87+ WHITE OIL

| Property/Temperature | 0° C. | 20° C. | 25° C. | 38° C. | 50° C. |
|---|---|---|---|---|---|
| Density (kg/m$^3$) | $0.859\times10^3$ | $0.847\times10^3$ | $0.843\times10^3$ | $0.838\times10^3$ | $0.833\times10^3$ |
| Viscosity (m$^2$/Sec) | $113.19\times10^{-6}$ | $37.2\times10^{-6}$ | $29.55\times10^{-6}$ | $17.58\times10^{-6}$ | $11.66\times10^{-6}$ |
| Surface Tension (N/m) | 0.0333 | 0.0332 | 0.0328 | 0.0323 | 0.0310 |
| Molecular Weight (—) | — | *340 | — | — | — |
| Conductivity (Mho/m) | — | $0.3\times10^{-12}$ | — | — | — |

*Average; range 290 to 425.
+Marcol 87 is a mixture of 13% Primol 355 (a naphthalenic oil) and 87% Marcol 72.

EXAMPLE II

Experimental Apparatus

Tests were conducted using the Spray Triode device displayed in FIG. 6. Marcol 87 (Exxon Chemical Co.) was used exclusively as the test fluid. The test hand was machined from a Lucite 1¼" OD rod with an 11.9 mm diameter cylindrical chamber. The lower portion of this chamber transited into a 120° converging section which terminated in a 1 mm long 1 mm diameter exit port.

Emitter electrode 38, 11.8 mm diameter OD was fit to the chamber. Typically electrode 220 and between 10 mm and 13 mm long. A number of emitter electrodes having lengths between 10 mm and 13 mm were tested and behaved similarly. Electrode 220 consisted of 85 segments of industrial grade razor blades arranged radially with the sharpened edges toward the inside and parallel to the unit's center line. The razor blade edges were used. To limit possible damage from flashover between the emitting or collecting electrode and the external electrode 82, a 100 megΩ was interposed between electrode 82 and ground.

Electrometers were used to measure the blunt electrode 64 current $I_b$, the current flow $I_e$ to the external electrode 82 and the spray current $I_c$. A collector receptacle filled with stainless steel wool and covered with a stainless steel screen served to collect the spray current. This receptacle 15 cm in diameter and 10 cm high, was positioned 20 cm below the spray head. For those tests involving vigorous spraying a 15 cm diameter screen extension was mounted on top of the receptacle to assure complete spray collection. Receptacle potential was maintained close to ground by the electrometer used to measure $I_c$, for measurements in the microampere in the range this resistance corresponded to 1 megΩ.

Input current ($I_a$) to the emitting electrode 38 was monitored using an insulated 0–100 $\mu$a panel meter. Input voltage $V_a$ was measured at this point. Blunt electrode voltage ($V_b$) was computed from the known resistance value R and measured $I_b$. In all instances the value of R was verified over the operating voltage range by shorting electrode (A) and (B) under no flow conditions measuring $I_b$ as a function of $V_a$. The $V_a/I_b/_{A-B\ shorted}=R$.

Measured external electrode collected currents ($I_e$) were typically in the nanoampere range or lower. Therefore except at the highest voltages tested ($\gtrsim$24 KV) where this electrode produced flow rate enhancement (9%) by virtue of the electric field between (E) and the charged fluid interior to the device the external electrode was not essential. The collection receptacle formed the major return path for the charged spray current and therefore functioned as the third electrode of the Spray Triode.

All testing was conducted with a calibrated dropping funnel gravity flow system capable of supplying flow rates in the range 1.25 to 1.67 ml/sec. Flow rate varied with oil temperature, details of the blunt electrodes position with respect to the exit port area and the applied voltage level but for each set of conditions was constant to within 3%. Oil temperatures were in the range 18° C. to 24° C.

In all tests, within experimental accuracy it was verified that total emitted current $I_a$ equalled the sum of the blunt electrode current $I_b$ and the collected current $I_c$ i.e. $I_a=I_b+I_c$. No quantitative measurements of droplet number or charge to mass ratio distribution were obtained. The presence of spraying and a qualitative indication of its vigor were noted for each test. Therefore $V_a$, $I_b$, $I_c$, the flow rate m and the value of resistance R used were the major quantitative parameters recorded for each test.

In the first test with the Spray Triode stable spraying was obtained for $-22$ $-V_a$ 27.5 KV with R=1800 meg$\Omega$. Vigorous break-up of the jet occurred ~5 cm downstream of the head. By contrast when the resistor between the blunt electrode and ground was disconnected (R$-\infty$) no spraying occurred for $V_a$ up to $-27\frac{1}{2}$ KV. In these tests the external electrode was in place. With only two electrodes (electrode 64 disconnected) the device functioned as a spray diode. In this mode the exiting stream remained a laminar glassy smooth circular jet 1 mm diameter from the spray head to the receptacle. No physical alternation could be observed as applied voltage $V_a$ was increased up to the maximum used, 30 KV. Collected currents $I_c$ were in the nanoampere range for operation as a diode.

The Spray Triode produces spraying by forceably injecting charge into the liquid to be atomized. Electrons are field emitted from the sharp edges of razor electrode 38 under the action of the electric field that exists between 38 and 64. Therefore the fluid in the annular gap 224 has an excess free charge. The physical displacement of charged fluid from the annular gap region to the exterior permits liquid fragmentation to proceed.

An approximate model of this process, against which the experimental data can be compared, and the overall validity of the concept tested, can be developed. A tractable model can be constructed if it is first assumed that space charge effects (i.e. the free excess change that is forceably injected into the liquid can be neglected). Further neglecting edge effects, the electric field in the gap interior $$E=\frac{V_{ab}\sqrt{a}\sqrt{b}}{r^2(r_a-r_b)}$$

where $\sqrt{a}$=interior radius of emitting electrode 212; $\mu_b$=radius of blunt collecting electrode 64; $V_{ab}$=gap potential difference=$V_a-I_bR$.

Ideally, the emitting electrode should be interior to the blunt electrode. With this arrangement the field emitter edges would be in the strongest E field possible for a given applied gap voltage. Fabrication difficulties forced the emitters to be constructed as noted.

Considering conditions in the vicinity of the blunt electrode 64 we can write, using the electrode dimensions $$E_b=1.89\times10^3\ V_{ab}\ (V/m)$$

using $\sqrt{a}$=2.38 mm, $\sqrt{b}$=1.58 mm

Current density at the blunt electrode surface is $J_b=V_m\rho e$ (A/m$^2$) where $V_m$=mobility velocity of the charge carriers (m/sec)

$\rho e$=free excess charge density in the fluid (C/m$^3$)

The mobility velocity in the vicinity of the blunt electrode surface is, by definition, $$V_{mb}=\mu E_b$$

where $\mu$=mobility of electrons in the liquid m$^2$/V.sec.

Since $I_b=J_bA_b$ where $A_b$=lateral area of the blunt electrode (for 13 mm long blunt electrode $A_b$=1.04 cm$^2$.)

we write $$E_b=\frac{V_{ab}}{(rb)/ra)(r_a-r_b)}=\frac{V_a-I_bR}{(r_a/r_b)(r_a-r_b)}=\frac{V_a-I_bR}{(r_a/r_b)(r_a-r_b)}$$

or $$\frac{V_a}{I_b}=E_b\frac{(ra/rb)(r_a-r_b)}{I_b}+R$$

or $$\frac{V_a}{I_b}=\frac{E_b(\sqrt{a}/\sqrt{b})(\sqrt{a}-\sqrt{b})}{\mu\rho eA_b}+R$$

Numerically using the dimensions noted $$\frac{V_a}{I_b}=\frac{5.09}{\mu\rho e}+R$$

Extensive data taken at voltages 20 KV$\leqq-V_a\leqq$28 KV, $I_b$ up to ~30 $\mu$a and 500 meg$\Omega\leqq R\leqq$5000 meg$\Omega$permitted the following empirical relationship to be developed for a spray head using stainless steel screen blunt electrode and operating on Marcol 87.

$$V_a/I_b=0.401\times10^9+1.30\ R\quad 20\ KV\leqq-V_a\leqq28\ KV$$

All data fell within ±10% of this line. An empirical least mean square fit to the data taken in the range 15 KV$\leqq-V_a\leqq$28 KV with the same resistance values resulted in a similar expression.

$$V_a/I_b=0.58\times10^9+1.28\ R\quad 15\ KV\leqq-V_a\leqq28\ KV$$

with all data falling within ~20% of this line.

The non-unity coefficient of R is interpreted as a manifestation of space charge effects, which were neglected in the simplified model expression. Making a direct comparison between the empirical expression ($-V_a$, 20 KV to 28 KV) and the idealized expression permits the $\mu\rho_e$ product to be estimated as $$\mu\rho_e = 1.3\times10^{-8}\ (\text{mho/m})$$

Note that $\mu\rho_e$ can be considered an effective conductivity. Compare this value with the intrinsic conductivity of Marcol, cf. Table 1. For hydrocarbons in general $10^{-8} \leqq \mu \leqq 10^{-7}$ or $\rho e \geqq 0.13$ C/m$^3$. The free excess charge density $\rho_e$ is simply related to the fluids charge to mass ratio Q/m C/kg.

$Q/m = \rho_e/\rho$ where $\rho$=mass density kg/m$^3$. For Marcol 87, $\rho$=845 kg/m$^3$.

It is therefore anticipated that Marcol sprays from the spray triode described should have a charge to mass ratio of $Q/M \gtrsim 1.5\times10^{-4}$ C/kg.

Up to this work no data were available concerning the mobility of Marcol 87. Measurements of $I_c$ and mass flow permitted the mean charge to mass ratio to be obtained $Q/M/_{mean} = I_c/\dot{m}$. Mean charge to mass ratios of from $1\times10^{-4}$ to $2.2\times10^{-4}$ C/kg have been consistently observed using the device depicted in FIG. 6. These data permit the mobility of Marcol to be obtained directly from the measurement of $I_b$, $I_c$ and $V_a$ $$\rho e = (Q1m)\rho = \frac{I_c}{\dot{m}}\rho = I_c\dot{Q}$$

where Q=volumetric mass flow in ml/Sec.

Numerically for the geometry noted $$\mu = 5.14\times10^{-6}\frac{(I_b/I_c)}{(V_a - I_bR)}\dot{Q}$$

Plotting $I_b/I_c$ vs $(V_a - I_bR)$ a linear regression fit to the data permitted the following relation to be developed—

$$I_b/I_c = 61.24 + 14.37\times10^{-3}\,[-(V_a - I_bR)]$$

The constant factor represents an offset voltage (−4.26 KV) below which no emission was observed. Above this value the data taken at $\dot{Q}$=1.67 ml/sec flow rate admitted to a mean mobility of $$\mu = 1.29\times10^{-7}\ \text{m}^2/\text{V.sec.}$$

This corresponds to a mean charge to mass ratio of $1.2\times10^{-4}$ C/kg. A maximum gap potential difference of 11 KV was observed. Beyond this value, breakdown would occur. This corresponds to a maximum sustainable electric field of $E_b = 2.08\times10^7$ V/m.

It is worth noting that the measured conductivity of fresh Marcol is $3\times10^{-13}$ mho/m. After several months of use the remeasured conductivity was found to be $9\times10^{-13}$ mho/m or less. Using this value and the maximum E field the maximum conduction current density is $$J = gE = 1.87\times10^{-5}\ A/m^2$$

For a total blunt electrode area of 1.04 Cm$^2$ this corresponds to $I_b \sim 2\eta a$. By comparison, $I_b$ for $V_{ab} \approx -11$ KV ~30 $\mu$a. Therefore, in this case charge injection by field emitting electron with the spray fluid has lead to a current enhancement by a factor of at least $10^4$.

Mobility velocity under maximum E field conditions ~2.68 m/sec. By contrast mean fluid velocity was typically 0.17 m/sec. From this and the known flow passage geometry the ratio $I_c/I_b$ can be roughly estimated. The calculated value $I_c/I_b$ 0.005 is about half the observed value. This divergence between theory and observation is not unexpected in light of the neglect of both space charge and fringe field effects, and the details of the viscosity dominated flow field.

Emitted current density for maximum sustainable electric field conditions ($V_{ab} \approx -11$ KV), is from the empirical relation for ($-V_a$, 15 to 28 KV and R=1000 megΩ) ~5.5 $\mu$a/cm$^2$.

EXAMPLE III

Initial exploratory experiments were conducted using the device shown in FIG. 7. Marcol 87 flowed under gravity from a 500 ml dropping funnel positioned ~1 m above the spray head at a mean flow rate of 1.2 ml/sec. Dropping funnel fluid height was maintained at a constant level by a small pump which returned the spray fluid to the funnel. Electrode 38 was formed from a Dyno Item 228 nickel plated straight pin 223 whose tip was burnished sharp on glass under oil. Blunt electrode 64 consisted of a 4–40 stainless steel machine screw positioned coaxially with respect to pin electrode 38. The polished end of 64 was 2 mm from 221. The gap was symmetrically disposed with respect to the center line of the luctie head. The interior chamber consisted of a 6.35 mm $\phi$ ($\frac{1}{4}$"$\phi$) diameter cylindrical section coaxial with the spray head. A 120° conical transition connected the chamber with the 1 mm $\phi$, 1 mm long cylindrical exit port.

The common electrode centerline was perpendicular to the chamber and 1 cm upstream of the exit port plane. A 0.64 mm thick stainless steel disc 31 mm OD with a 6 mm diameter hole, positioned flush with the exit port formed the external electrode 82.

Electrode 38 was energized by a high voltage power supply (NJE), capable of supplying up to 35 KV. A variety of high voltage resistors 72 were used to connect electrode 64 to ground. Most tests were conducted using three 100 meg.Ω resistors in series (R~33$\frac{1}{3}$ meg.Ω). The external electrode 82 was connected to ground via a 15 meg.Ω resistor which acted to limit current surge when breakdown occurred.

In this configuration charge injection was localized to the electrode gap region. Approximately 20% of the fluid flow passed thru the gap region, the remainder flowing outside the gap charge injection region. Injected charge was measured by collecting the exit stream in an isolated metal receptacle 15 cm in diameter. The top of which was located ~15 cm below the exit plane. Collected current ($I_c$) was measured with an electrometer.

A limited series of tests were conducted with the apparatus. Visual inspection of the exit jet was used as the primary measure of charge injection. Low values of $I_c$ ($\lesssim$10 na) made quantitative evaluation of this parameter too uncertain to be reliable.

With R≈33$\frac{1}{2}$ MegΩ the exit jet remained glassy smooth (laminar) to applied voltages (Vâ) up to ~−20 KV. Above this level a region of turbulence and breakup could be observed at the bottom of the jet where it entered the steel wool in the receptacle. As voltage was increased beyond this level, the breakup region monotonically rose toward the head until at the maximum voltage tested (−27.5 KV), it was observed to start ~3 cm below the head.

At the maximum voltage condition, the lower portion of the breakup region had spread to a diameter of ~4 mm and was observed to be composed of droplets on the order of 1 mm in diameter. Tests under similar conditions with the external resistor disconnected, i.e. operating the device as a spray diode produced fundamentally different results. The exit jet remained a glassy smooth rod from exit plane to receptacle entrance, independent of voltage, up to and including the maximum used (−27.5 KV).

This difference in behavior was taken as clear evidence of charge injection induced breakup, but was too qualitative for proof of concept validation.

What is claimed is:

1. An electrostatic charging device for electrostatically atomizing fluids into a plurality of charged droplets which includes:

(a) a housing having a chamber therein, said fluid being disposed within said chamber;

(b) means for generating an electrical charge and passing an electrical charge through said fluid in said chamber thereby generating a free excess charge in said fluid within said chamber; wherein said generating means for said electrical charge includes at least a first and a second electrode, said first and said second electrodes being in liquid contact with said fluid within said chamber.

(c) a ground electrode disposed externally to said housing, said ground electrode forming an electrostatic field; and (d) means for issuing said fluid from said chamber in the form of said charged droplets, said charged droplets passing through said electrostatic field.

2. A device according to claim 1 wherein said first electrode is wired in series to a high voltage source

3. A device according to claim 1 wherein a flow of said charge within said chamber is colinear with flow of said fluid within said chamber.

4. A device according to claim 1 wherein a flow of said charge within said chamber intersects at an angle a flow of said fluid within said chamber.

5. A device according to claim 4 wherein said angle of intersection is about 90°.

6. A device according to claim 1 further including a convective flow of said fluid being higher than a mobility controlled current flow velocity of a current in said chamber, said generated charge in said fluid being convected to said discharge spray means.

7. A device according to claim 1 further including a convective flow of said fluid being equal to or less than a mobility controlled current flow velocity of a current in said chamber, said generated charge in said fluid being convected to said discharge spray means.

8. A device according to claim 1 further including a plurality of said first electrodes, each said first electrode wired in parallel or in parallel, series combination to a high voltage source.

9. A device according to claim 8 further including a plurality of said second electrodes, each said second electrode wires in parallel or in parallel, series combination to a ground.

10. A device according to claim 1 wherein said first electrode is disposed transversely in said chamber, at least one surface of said first electrode being pointed, setaceous or edged.

11. A device according to claim 1 wherein said second electrode disposed transversely through said chamber and below said first electrode at least one surface of said second electrode being blunt.

12. A device according to claim 1 wherein said third electrode is a conductive annular ring, said ring being disposed externally to and around said issuing means, an axis of said ring being colinearly aligned to a said discharge spray means.

13. A device according to claim 1 wherein said high voltage source is less than about 100 kilovolts.

14. A process for electrostatically charging a fluid and electrostatically atomizing said charged fluid into a plurality of charged droplets which comprises the steps of:

(a) injecting a fluid into a chamber of a housing;

(b) injecting an electrical charge through said fluid in said chamber, said electrical charge generating a free excess charge in said fluid within said chamber; wherein a means for forming said electrical charge includes at least a first electrode and a second electrode, said first and said second electrodes being in liquid contact with said fluid within said chamber;

(c) ejecting said fluid from said chamber in the form of said charged droplets; and (d) directing said formed charge droplets towards an electrostatic field disposed externally to said housing, said electrostatic field being produced by a voltage differential between said fluid and an electrode disposed externally to said housing.

15. A process according to claim 14 further including a convective flow velocity of said fluid being higher than a mobility controlled current flow velocity of a current in said chamber, said generated charge in said fluid being convected to said discharge spray means.

16. A process according to claim 14 further including a convective flow velocity of said fluid being equal to or less than a mobility controlled current flow velocity of a current in said chamber, said generated charge in said fluid being convected to said discharge ejecting means.

17. A process according to claim 14 further including a flow of said charge being colinear to a flow of said fluid within said chamber.

* * * * *